US007010921B2

(12) United States Patent
Intile et al.

(10) Patent No.: US 7,010,921 B2
(45) Date of Patent: Mar. 14, 2006

(54) METHOD AND APPARATUS FOR COOLING COMBUSTOR LINER AND TRANSITION PIECE OF A GAS TURBINE

(75) Inventors: John Charles Intile, Simpsonville, SC (US); James A. West, Simpsonville, SC (US); William Byrne, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 10/709,886

(22) Filed: Jun. 1, 2004

(65) Prior Publication Data

US 2005/0268613 A1 Dec. 8, 2005

(51) Int. Cl.
*F02C 1/00* (2006.01)
*F02G 3/00* (2006.01)

(52) U.S. Cl. ..... 60/752; 60/754; 60/760

(58) Field of Classification Search ..... 60/752–760, 60/722

See application file for complete search history.

(56) References Cited

U.S. PATENT DOCUMENTS 3,349,558 A * 10/1967 Smith ..... 60/754
4,191,011 A * 3/1980 Sweeney et al. ..... 60/796
4,195,475 A * 4/1980 Verdouw ..... 60/754
4,232,527 A * 11/1980 Reider ..... 60/754
4,236,378 A * 12/1980 Vogt ..... 60/757
4,653,279 A * 3/1987 Reynolds ..... 60/757
4,719,748 A * 1/1988 Davis et al. ..... 60/39.37
4,864,827 A * 9/1989 Richardson et al. ..... 60/756
4,903,477 A * 2/1990 Butt ..... 60/39.37
4,916,905 A * 4/1990 Havercroft et al. ..... 60/756
5,094,069 A * 3/1992 Boffo ..... 60/804
5,181,377 A * 1/1993 Napoli et al. ..... 60/796
5,329,773 A * 7/1994 Myers et al. ..... 60/759
5,461,866 A * 10/1995 Sullivan et al. ..... 60/757
5,758,504 A * 6/1998 Abreu et al. ..... 60/754
5,802,841 A * 9/1998 Maeda ..... 60/784
5,974,805 A * 11/1999 Allen ..... 60/740
6,098,397 A * 8/2000 Glezer et al. ..... 60/772

(Continued)

*Primary Examiner*—William H. Rodriguez
(74) *Attorney, Agent, or Firm*—Cantor Colburn LLP

(57) ABSTRACT

A method and apparatus for cooling a combustor liner and transitions piece of a gas turbine include a combustor liner with a plurality of circular ring turbulators arranged in an array axially along a length defining a length of the combustor liner and located on an outer surface thereof; a first flow sleeve surrounding the combustor liner with a first flow annulus therebetween including a plurality of axial channels (C) extending over a portion of an aft end portion of the liner parallel to each other, the cross-sectional area of each channel either constant or varying along the length of the channel, the first flow sleeve having a plurality of rows of cooling holes formed about a circumference of the first flow sleeve for directing cooling air from the compressor discharge into the first flow annulus; a transition piece connected to the combustor liner and adapted to carry hot combustion gases to a stage of the turbine; a second flow sleeve surrounding the transition piece a second plurality of rows of cooling apertures for directing cooling air into a second flow annulus between the second flow sleeve and the transition piece; wherein the first plurality of cooling holes and second plurality of cooling apertures are each configured with an effective area to distribute less than 50% of compressor discharge air to the first flow sleeve and mix with cooling air from the second flow annulus.

24 Claims, 7 Drawing Sheets

U.S. PATENT DOCUMENTS

| | | | | |
|---|---|---|---|---|
| 6,134,877 | A * | 10/2000 | Alkabie | 60/800 |
| 6,170,266 | B1 * | 1/2001 | Pidcock et al. | 60/755 |
| 6,408,628 | B1 * | 6/2002 | Pidcock et al. | 60/752 |
| 6,484,505 | B1 | 11/2002 | Brown et al. | 60/760 |
| 6,494,044 | B1 * | 12/2002 | Bland | 60/772 |
| 6,530,225 | B1 * | 3/2003 | Hadder | 60/772 |
| 6,681,578 | B1 | 1/2004 | Bunker | 60/772 |
| 6,718,774 | B1 * | 4/2004 | Razzell | 60/798 |
| 6,772,595 | B1 * | 8/2004 | Martling et al. | 60/737 |
| 2004/0079082 | A1 * | 4/2004 | Bunker | 60/752 |

* cited by examiner

METHOD AND APPARATUS FOR COOLING COMBUSTOR LINER AND TRANSITION PIECE OF A GAS TURBINE

BACKGROUND OF THE INVENTION

This invention relates to internal cooling within a gas turbine engine; and more particularly, to apparatus and method for providing better and more uniform cooling in a transition region between a combustion section and discharge section of the turbine.

Traditional gas turbine combustors use diffusion (i.e., non-premixed) combustion in which fuel and air enter the combustion chamber separately. The process of mixing and burning produces flame temperatures exceeding 3900° F. Since conventional combustors and/or transition pieces having liners are generally capable of withstanding a maximum temperature on the order of only about 1500° F. for about ten thousand hours (10,000 hrs.), steps to protect the combustor and/or transition piece must be taken. This has typically been done by film-cooling which involves introducing relatively cool compressor air into a plenum formed by the combustor liner surrounding the outside of the combustor. In this prior arrangement, the air from the plenum passes through louvers in the combustor liner and then passes as a film over the inner surface of the liner, thereby maintaining combustor liner integrity.

Because diatomic nitrogen rapidly disassociates at temperatures exceeding about 3000° F. (about 1650° C.), the high temperatures of diffusion combustion result in relatively large NOx emissions. One approach to reducing NOx emissions has been to premix the maximum possible amount of compressor air with fuel. The resulting lean premixed combustion produces cooler flame temperatures and thus lower NOx emissions. Although lean premixed combustion is cooler than diffusion combustion, the flame temperature is still too hot for prior conventional combustor components to withstand.

Furthermore, because the advanced combustors premix the maximum possible amount of air with the fuel for NOx reduction, little or no cooling air is available, making film-cooling of the combustor liner and transition piece premature at best. Nevertheless, combustor liners require active cooling to maintain material temperatures below limits. In dry low NOx (DLN) emission systems, this cooling can only be supplied as cold side convection. Such cooling must be performed within the requirements of thermal gradients and pressure loss. Thus, means such as thermal barrier coatings in conjunction with "backside" cooling have been considered to protect the combustor liner and transition piece from destruction by such high heat. Backside cooling involved passing the compressor discharge air over the outer surface of the transition piece and combustor liner prior to premixing the air with the fuel.

With respect to the combustor liner, one current practice is to impingement cool the liner, or to provide linear turbulators on the exterior surface of the liner. Another more recent practice is to provide an array of concavities on the exterior or outside surface of the liner (see U.S. Pat. No. 6,098,397). The various known techniques enhance heat transfer but with varying effects on thermal gradients and pressure losses. Turbulation strips work by providing a blunt body in the flow which disrupts the flow creating shear layers and high turbulence to enhance heat transfer on the surface. Dimple concavities function by providing organized vortices that enhance flow mixing and scrub the surface to improve heat transfer.

A low heat transfer rate from the liner can lead to high liner surface temperatures and ultimately loss of strength. Several potential failure modes due to the high temperature of the liner include, but are not limited to, cracking of the aft sleeve weld line, bulging and triangulation. These mechanisms shorten the life of the liner, requiring replacement of the part prematurely.

Accordingly, there remains a need for enhanced levels of active cooling with minimal pressure losses at higher firing temperatures than previously available while extending a combustion inspection interval to decrease the cost to produce electricity.

BRIEF DESCRIPTION OF THE INVENTION

The above discussed and other drawbacks and deficiencies are overcome or alleviated in an exemplary embodiment by an apparatus for cooling a combustor liner and transitions piece of a gas turbine. The apparatus includes a combustor liner with a plurality of circular ring turbulators arranged in an array axially along a length defining a length of the combustor liner and located on an outer surface thereof; a first flow sleeve surrounding the combustor liner with a first flow annulus therebetween including a plurality of axial channels (C) extending over a portion of an aft end portion of the liner parallel to each other, the cross-sectional area of each channel either constant or varying along the length of the channel, the first flow sleeve having a plurality of rows of cooling holes formed about a circumference of the first flow sleeve for directing cooling air from the compressor discharge into the first flow annulus; a transition piece connected to the combustor liner and adapted to carry hot combustion gases to a stage of the turbine; a second flow sleeve surrounding the transition piece a second plurality of rows of cooling apertures for directing cooling air into a second flow annulus between the second flow sleeve and the transition piece; wherein the first plurality of cooling holes and second plurality of cooling apertures are each configured with an effective area to distribute less than 50% of compressor discharge air to the first flow sleeve and mix with cooling air from the second flow annulus.

In yet another embodiment, a turbine engine includes a combustion section; an air discharge section downstream of the combustion section; a transition region between the combustion and air discharge section; a turbulated combustor liner defining a portion of the combustion section and transition region, the turbulated combustor liner including a plurality of circular ring turbulators arranged in an array axially along a length defining a length of the combustor liner and located on an outer surface thereof; a first flow sleeve surrounding the combustor liner with a first flow annulus therebetween, the first flow annulus including a plurality of axial channels (C) extending over a portion of an aft end portion of the liner parallel to each other, the cross-sectional area of each channel is one of substantially constant and varying along the length of the channel, the first flow sleeve having a plurality of rows of cooling holes formed about a circumference of the first flow sleeve for directing cooling air from compressor discharge air into the first flow annulus; a transition piece connected to at least one of the combustor liner and the first flow sleeve, the transition piece adapted to carry hot combustion gases to a stage of the turbine corresponding to the air discharge section; a second flow sleeve surrounding the transition piece, the second flow sleeve having a second plurality of rows of cooling apertures for directing cooling air into a second flow annulus between the second flow sleeve and the transition piece, the first flow annulus connecting to the second flow annulus; wherein the first plurality of cooling holes and second plurality of cooling apertures are each configured with an effective area to distribute less than 50% of compressor discharge air to the first flow sleeve and mix with cooling air from the second flow annulus serving to cool air flowing through the transition region of the engine between the combustion and air discharge sections thereof.

In an alternative embodiment, a method for cooling a combustor liner of a gas turbine combustor is disclosed. The combustor liner includes a substantially circular cross-section, and a first flow sleeve surrounding the liner in substantially concentric relationship therewith creating a first flow annulus therebetween for feeding air from compressor discharge air to the gas turbine combustor, and wherein a transition piece is connected to the combustor liner, with the transition piece surrounded by a second flow sleeve, thereby creating a second flow first annulus in communication with the first flow first annulus. The method includes providing a plurality of axially spaced rows of cooling holes in the flow sleeves, each row extending circumferentially around the flow sleeves, a first of the rows in the second sleeve is located proximate an end where the first second flow sleeve interface; supplying cooling air from compressor discharge to the cooling holes; and configuring the cooling holes with an effective area to distribute less than a third of compressor discharge air to the first flow sleeve and mix with a remaining compressor discharge air flowing from said second flow annulus.

The above-discussed and other features and advantages of the present invention will be appreciated and understood by those skilled in the art from the following detailed description and drawings.

BRIEF DESCRIPTION OF THE DRAWINGS

Referring now to the drawings wherein like elements are numbered alike in the several Figures.

DETAILED DESCRIPTION OF THE INVENTION

Figure 1:
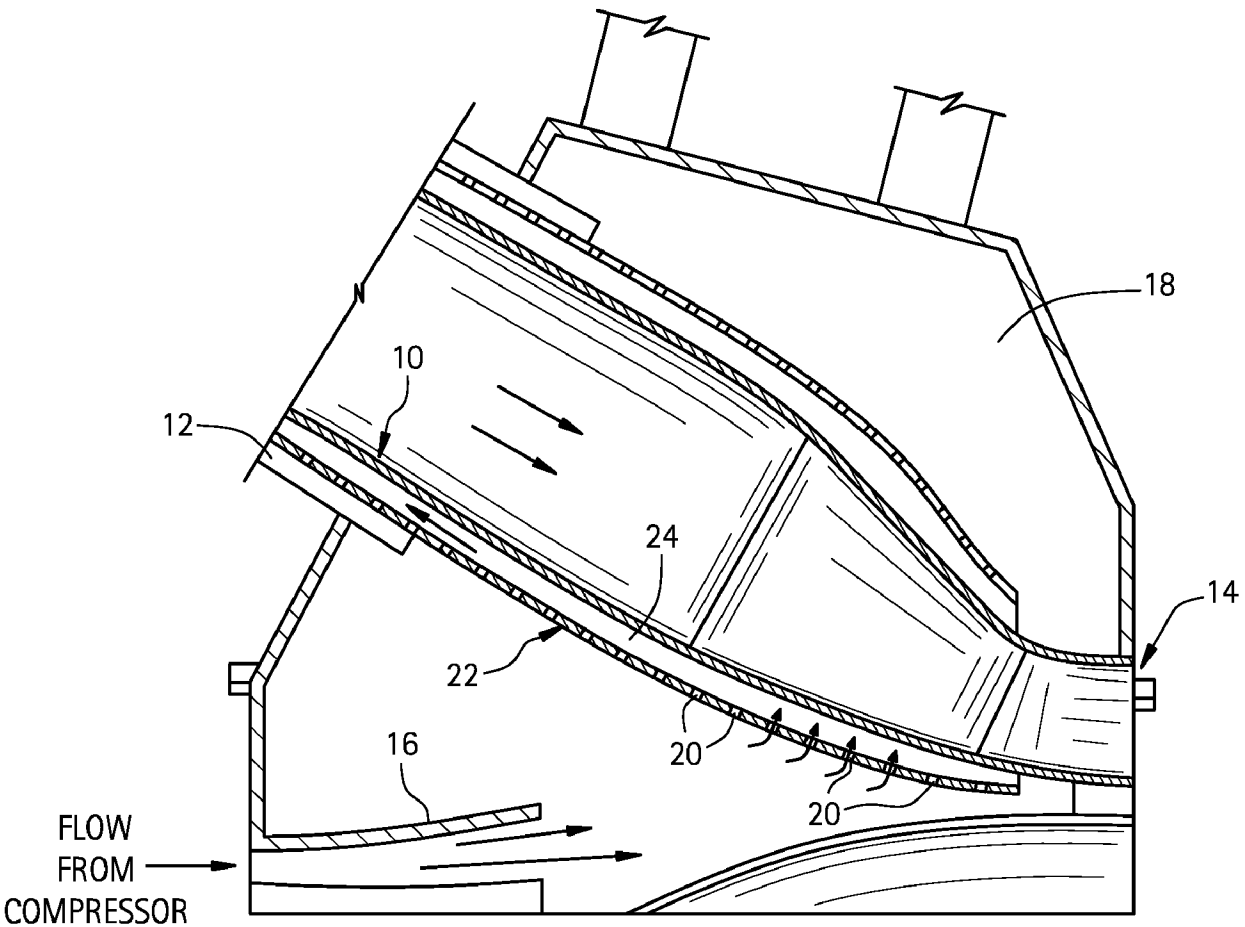
FIG. 1 PRIOR ART
FIG. 1 is a simplified side cross section of a conventional combustor transition piece aft of the combustor liner.
Figure 2:
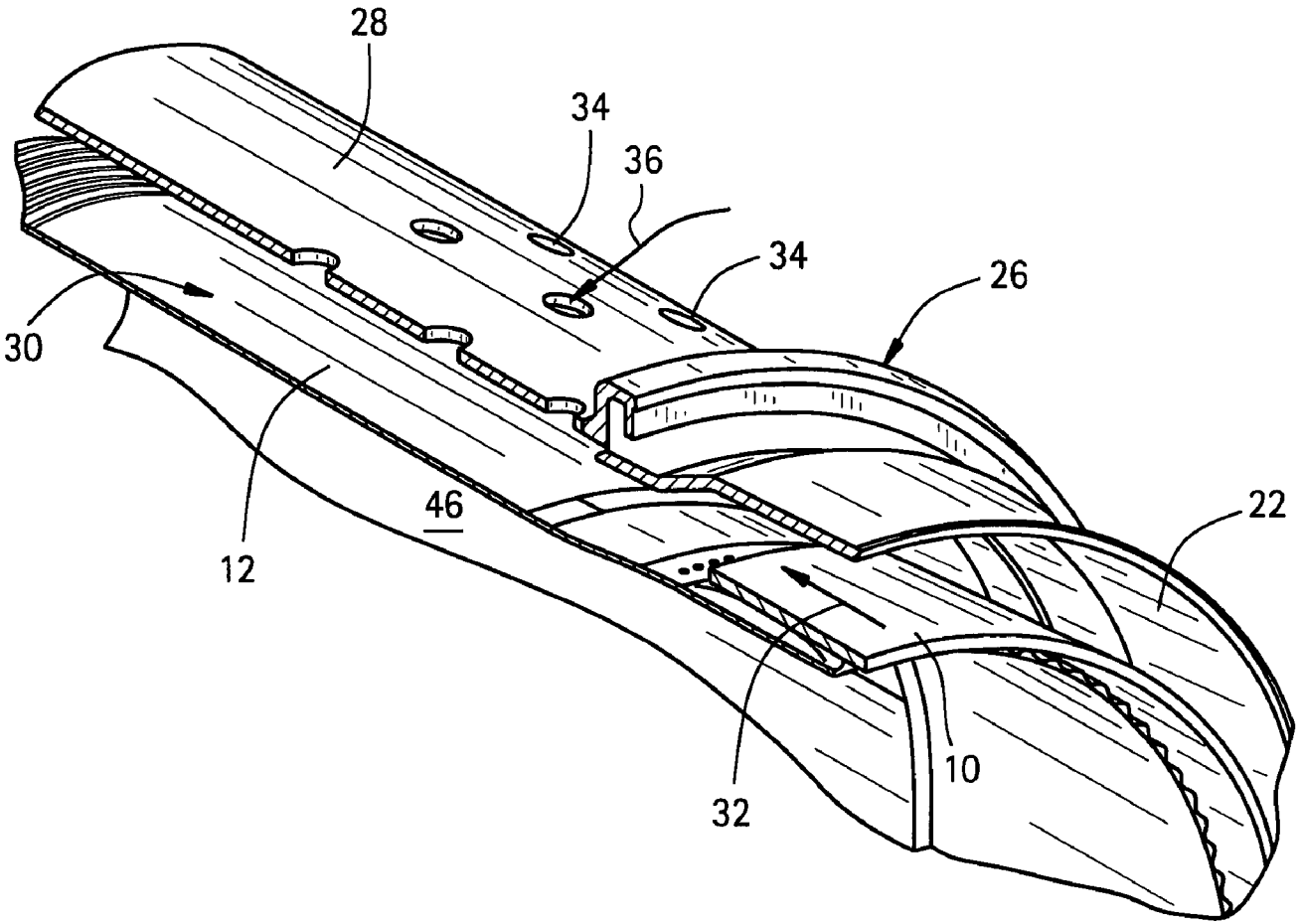
FIG. 2 is a partial but more detailed perspective of a conventional combustor liner and flow sleeve joined to the transition piece.

With reference to FIGS. 1 and 2, a typical gas turbine includes a transition piece 10 by which the hot combustion gases from an upstream combustor as represented by the combustor liner 12 are passed to the first stage of a turbine represented at 14. Flow from the gas turbine compressor exits an axial diffuser 16 and enters into a compressor discharge case 18. About 50% of the compressor discharge air passes through apertures 20 formed along and about a transition piece impingement sleeve 22 for flow in an annular region or annulus 24 (or, second flow annulus) between the transition piece 10 and the radially outer transition piece impingement sleeve 22. The remaining approximately 50% of the compressor discharge flow passes into flow sleeve holes 34 of an upstream combustion liner cooling sleeve (not shown) and into an annulus between the cooling sleeve and the liner and eventually mixes with the air in annulus 24. This combined air eventually mixes with the gas turbine fuel in a combustion chamber.

FIG. 2 illustrates the connection between the transition piece 10 and the combustor flow sleeve 28 as it would appear at the far left hand side of FIG. 1. Specifically, the impingement sleeve 22 (or, second flow sleeve) of the transition piece 10 is received in a telescoping relationship in a mounting flange 26 on the aft end of the combustor flow sleeve 28 (or, first flow sleeve), and the transition piece 10 also receives the combustor liner 12 in a telescoping relationship. The combustor flow sleeve 28 surrounds the combustor liner 12 creating a flow annulus 30 (or, first flow annulus) therebetween. It can be seen from the flow arrow 32 in FIG. 2, that crossflow cooling air traveling in the annulus 24 continues to flow into the annulus 30 in a direction perpendicular to impingement cooling air flowing through the cooling holes 34 (see flow arrow 36) formed about the circumference of the flow sleeve 28 (while three rows are shown in FIG. 2, the flow sleeve may have any number of rows of such holes).

Still referring to FIGS. 1 and 2, a typical can annular reverse-flow combustor is shown that is driven by the combustion gases from a fuel where a flowing medium with a high energy content, i.e., the combustion gases, produces a rotary motion as a result of being deflected by rings of blading mounted on a rotor. In operation, discharge air from the compressor (compressed to a pressure on the order of about 250–400 $lb/in^2$) reverses direction as it passes over the outside of the combustor liners (one shown at 12) and again as it enters the combustor liner 12 en route to the turbine (first stage indicated at 14). Compressed air and fuel are burned in the combustion chamber, producing gases with a temperature of between about 1500° C. and about 2800° F. These combustion gases flow at a high velocity into turbine section 14 via transition piece 10.

Hot gases from the combustion section in combustion liner 12 flow therefrom into section 16. There is a transition region indicated generally at 46 in FIG. 2 between these two sections. As previously noted, the hot gas temperatures at the aft end of section 12, the inlet portion of region 46, is on the order of about 2800° F. However, the liner metal temperature at the downstream, outlet portion of region 46 is preferably on the order of 1400°–1550° F. To help cool the liner to this lower metal temperature range, during passage of heated gases through region 46, liner 12 is provided through which cooling air is flowed. The cooling air serves to draw off heat from the liner and thereby significantly lower the liner metal temperature relative to that of the hot gases.

Figure 3:
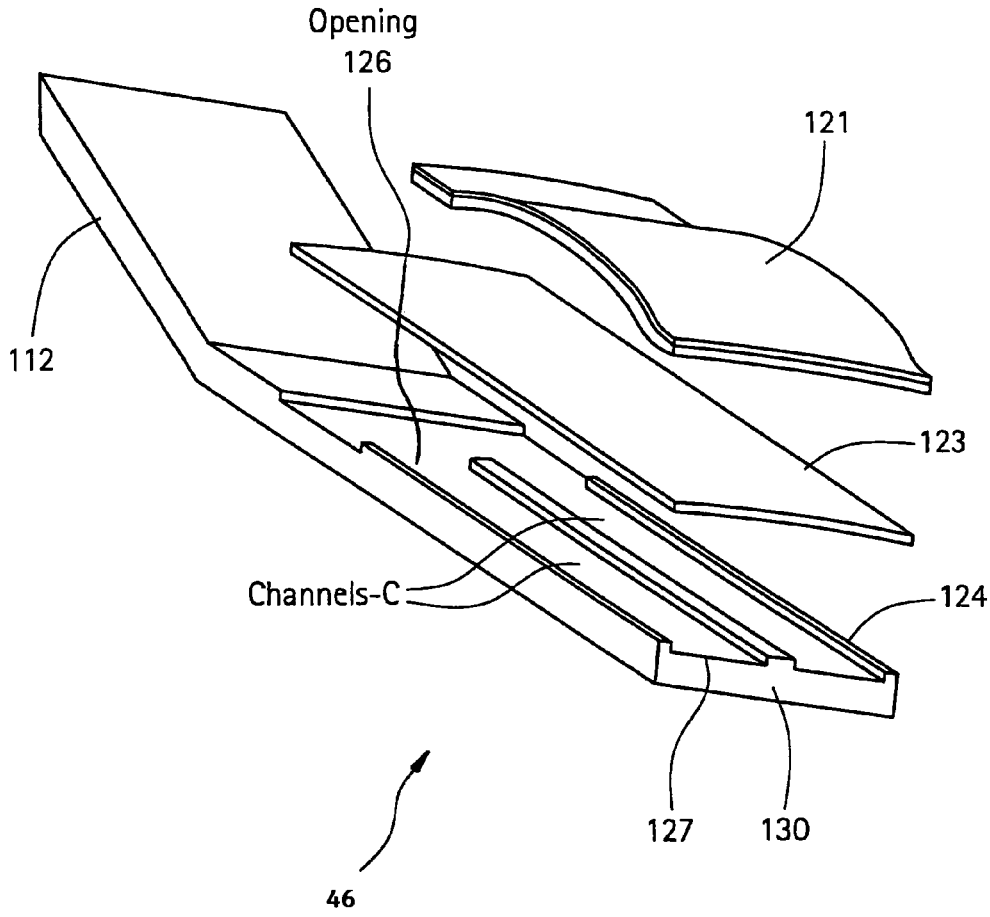
FIG. 3 is an exploded partial view of a liner aft end in accordance with an exemplary embodiment.

In an exemplary embodiment referring to FIG. 3, liner 112 has an associated compression-type seal 121, commonly referred to as a hula seal, mounted between a cover plate 123 of the liner 112, and a portion of transition region 46. The cover plate is mounted on the liner to form a mounting surface for the compression seal and to form a portion of the axial airflow channels C. As shown in FIG. 3, liner 112 has a plurality of axial channels formed with a plurality of axial raised sections or ribs 124 all of which extend over a portion of aft end of the liner 112. The cover plate 123 and ribs 124 together define the respective airflow channels C. These channels are parallel channels extending over a portion of aft end of liner 112. Cooling air is introduced into the channels through air inlet slots or openings 126 at the forward end of the channel. The air then flows into and through the channels C and exits the liner through openings 127 at an aft end 130 of the liner.

In accordance with the disclosure, the design of liner 112 is such as to minimize cooling air flow requirements, while still providing for sufficient heat transfer at aft end 130 of the liner, so to produce a uniform metal temperature along the liner. It will be understood by those skilled in the art that the combustion occurring within section 12 of the turbine results in a hot-side heat transfer coefficient and gas temperatures on an inner surface of liner 112. Outer surface (aft end) cooling of current design liners is now required so metal temperatures and thermal stresses to which the aft end of the liner is subjected remain within acceptable limits. Otherwise, damage to the liner resulting from excessive stress, temperature, or both, significantly shortens the useful life of the liner.

Liner 112 of the present invention utilizes existing static pressure gradients occurring between the coolant outer side, and hot gas inner side, of the liner to affect cooling at the aft end of the liner. This is achieved by balancing the airflow velocity in liner channels C with the temperature of the air so to produce a constant cooling effect along the length of the channels and the liner.

Figure 4:
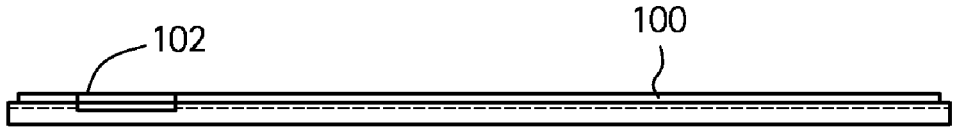
FIG. 4 PRIOR ART
FIG. 4 is an elevation view of a prior art aft liner region and an aft liner region of the present invention for flowing cooling air through a plurality of channels in a transition region of the turbine.

As shown in FIG. 4, a prior art liner, indicated generally at 100, has a flow metering hole 102 extending across the forward end of the cover plate. As indicated by the dotted lines extending the length of liner 100, the cross-section of the channel, as defined by its height, is constant along the entire length of the channel. This thickness is, for example, 0.045" (0.11 cm).

Figure 5:
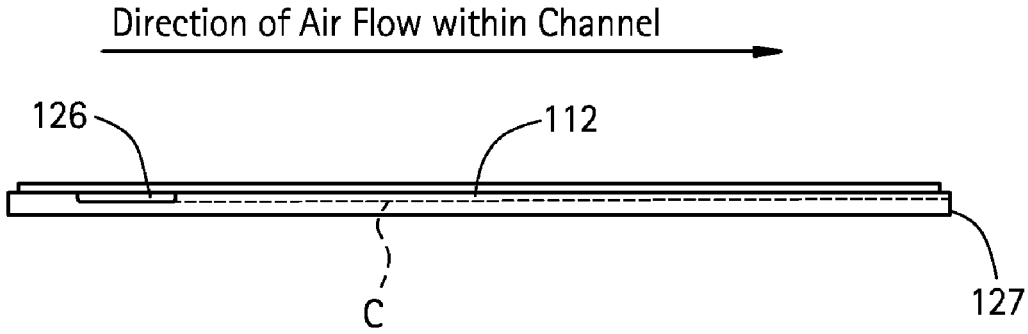
FIG. 5 is an elevation view of an aft liner region of the present invention for flowing cooling air through a plurality of channels in a transition region of the turbine.

In contrast referring to FIG. 5, liner 112 of the present invention has a channel height which is substantially (approximately 45%) greater than the channel height of liner 100 at inlet 126 to the channel. However, this height steadily and uniformly decreases along the length of channel C so that, at the aft end of the channel, the channel height is substantially (approximately 55%) less than exit height of prior art liner 100. Liner 112 has, for example, an entrance channel height of 0.065" (0.16 cm) and an exit height of, for example, 0.025" (0.06 cm), so the height of the channel decreases by slightly more than 60% from the inlet end to the outlet end of the channel.

In comparing prior art liner 100 with liner 112 of the present invention, it has been found that reducing the height of the channels (not shown) in liner 100, in order to match the cooling flow of liner 112, will not provide sufficient cooling to produce acceptable metal temperatures in liner 100, nor does it effectively change; i.e., minimize, the flow requirement for cooling air through the liner. Rather, it has been found that providing a variable cooling passage height within liner 112 optimizes the cooling at aft end 130 of the liner. With a variable channel height, optimal cooling is achieved because the local air velocity in the channel is now balanced with the local temperature of the cooling air flowing through the channel. That is, because the channel height is gradually reduced along the length of each channel, the cross-sectional area of the channel is similarly reduced. This results in an increase in the velocity of the cooling air flowing through channels C and can produce a more constant cooling heat flux along the entire length of each channel. Liner 112 therefore has the advantage of producing a more uniform axial thermal gradient, and reduced thermal stresses within the liner. This, in turn, results in an increased useful service life for the liner. As importantly, the requirement for cooling air to flow through the liner is now substantially reduced, and this air can be routed to combustion stage of the turbine to improve combustion and reduce exhaust emissions, particularly NOx emissions.

Figure 6:
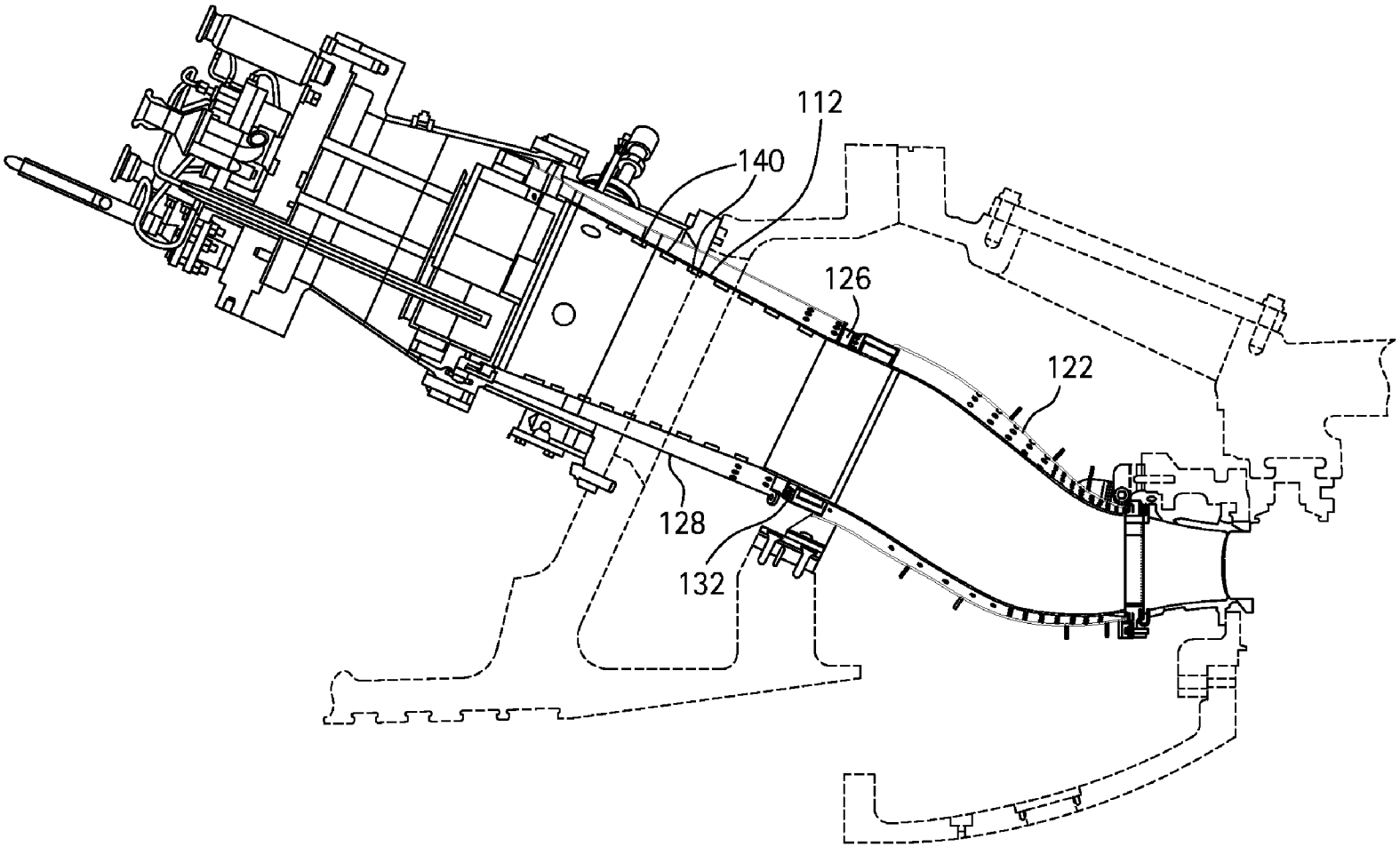
FIG. 6 is a side cross section view of a combustor having a flow sleeve and impingement sleeve surrounding a combustor liner and transition piece in accordance with an exemplary embodiment.
Figure 7:
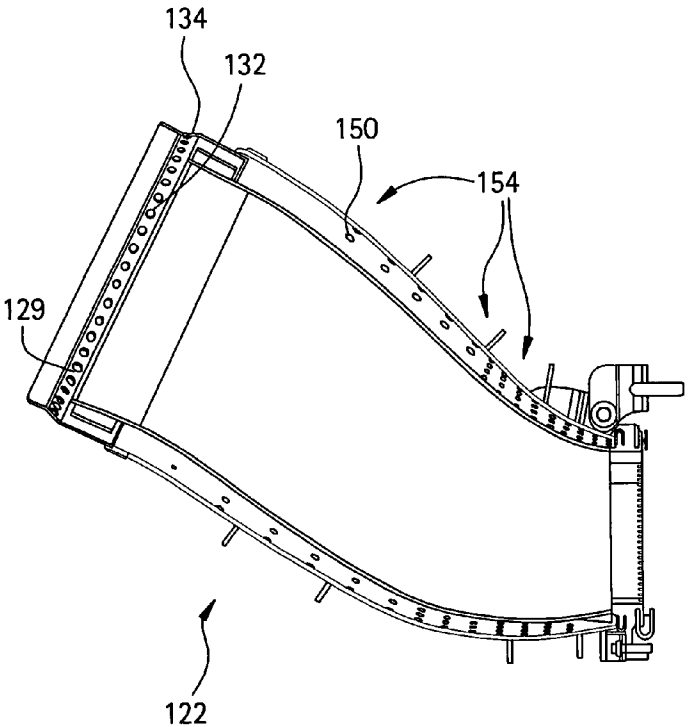
FIG. 7 is an enlarged view of the impingement sleeve of FIG. 6.

Referring now to FIGS. 6 and 7, an exemplary embodiment of an impingement sleeve 122 is illustrated. Impingement sleeve 122 includes a first row 129 or row 0 of 48 apertures circumferentially disposed at a forward end generally indicated at 132. However, it will be recognized by one skilled in the pertinent art that any number of apertures 132 is contemplated suitable to the desired end purpose. Each aperture 130 has a diameter of about 0.5 inch. Row 0 or a lone row 129 of apertures 132 uniformly allow fresh air therethrough into impingement sleeve annulus 24 prior to entering flow sleeve annulus 30. Row 0 is located on an angular portion 134 of sleeve 122 directing air flow therethrough at an acute angle relative to a cross airflow path through annuli 24 and 30. Lone row 129 of cooling holes (Row 0 apertures 132) disposed towards the forward end of the impingement sleeve 122 are used to control the levels of impingement from the flow sleeve holes, thus avoiding cold streaks.

More specifically, flow sleeve 128 includes a hole arrangement without disposing thimbles therethrough to minimize flow impingement on liner 112. Such combustor liner cooling thimbles are disclosed in U.S. Pat. No. 6,484,505, assigned to the assignee of the present application and is incorporated herein in its entirety. Furthermore, liner 112 is fully turbulated, thus reducing back side cooling heat transfer streaks on liner 112. Fully turbulated liner 112 includes a plurality of discrete raised circular ribs or rings 140 on a cold side of combustor liner 112, such as those described in U.S. Pat. No. 6,681,578, assigned to the assignee of the present application and is incorporated herein in its entirety.

In accordance with an exemplary embodiment, combustor liner 112 is formed with a plurality of circular ring turbulators 140. Each ring turbulator 140 comprises a discrete or individual circular ring defined by a raised peripheral rib that creates an enclosed area within the ring. The ring turbulators are preferably arranged in an orderly staggered array axially along the length of the liner 112 with the rings located on the cold side or backside surface of the liner, facing radially outwardly toward a surrounding flow sleeve 128. The ring turbulators may also be arranged randomly (or patterned in a non-uniform but geometric manner) but generally uniformly across the surface of the liner.

While circular ring turbulators 140 are mentioned, it will be appreciated that the turbulators may be oval or other suitable shapes, recognizing that the dimensions and shape must establish an inner dimple or bowl that is sufficient to form vortices for fluid mixing. The combined enhancement aspects of full turbulation and vortex mixing serve along with providing a variable cooling passage height within liner 112 to optimize the cooling at aft end 128 of the liner to improve heat transfer and thermal uniformity, and result in lower pressure loss than without such enhancement aspects.

It will also be noted that row 0 cooling holes 132 provide a cooling interface between slot 126 in sleeve 128 and a first row 150 of fourteen rows 154 (1–14) in sleeve 122. Row 0 minimizes heat streaks from occurring in this region.

Inclusion of row 0 of cooling holes 132 further enhances a cooling air split between flow sleeve 128 and impingement sleeve 122. It has been found that an air split other than 50—50 between the two sleeves 128, 122 is desired to optimize cooling, to reduce streaking, and to reduce the requirement for cooling air to flow through the liner.

Air distribution between the cooling systems for the liner 112 (flow sleeve 128) and transition piece 10 (impingement sleeve 122) is controlled by the effective area distribution of air through the flow sleeve 128 and impingement sleeve 122. In an exemplary embodiment, a target cooling air split from exiting compressor discharge includes flow sleeve 128 receiving about 32.7% of the discharge air and impingement sleeve 122 receiving about 67.3% of the discharge air based on CFD prediction.

Transition pieces 10 and their associated impingement sleeves are packed together very tightly in the compressor discharge casing. As a result, there is little area through which the compressor discharge air can flow in order to cool the outboard part of the transition duct. Consequently, the air moves very rapidly through the narrow gaps between adjacent transition duct side panels, and the static pressure of the air is thus relatively low. Since impingement cooling relies on static pressure differential, the side panels of the transition ducts are therefore severely under cooled. As a result, the low cycle fatigue life of the ducts may be below that specified. An example of cooling transition pieces or ducts by impingement cooling may be found in commonly owned U.S. Pat. No. 4,719,748.

Figure 8:
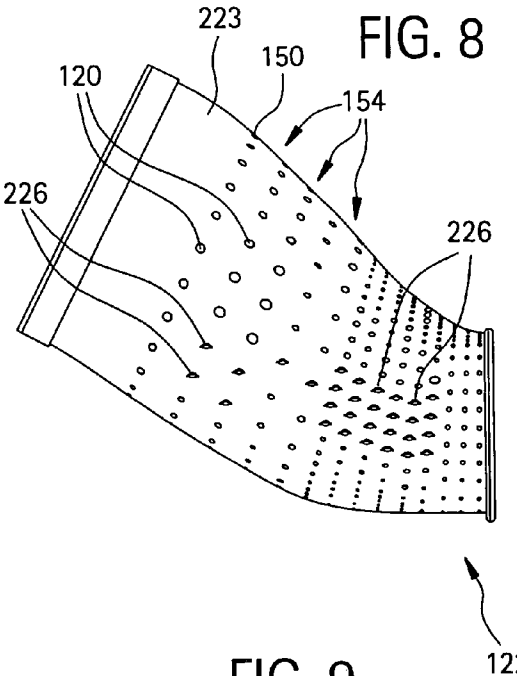
FIG. 8 is a simplified side elevation of an impingement sleeve, illustrating aerodynamic scoops in accordance with an exemplary embodiment.
Figure 9:
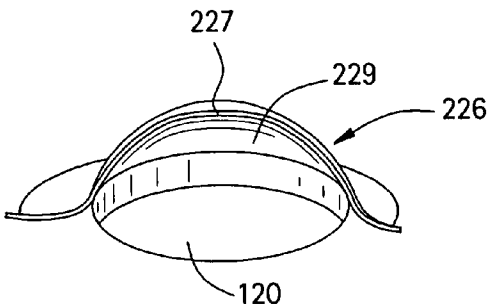
FIG. 9 is an enlarged detail of an aerodynamic scoop on the impingement sleeve.

FIG. 8 shows a transition piece impingement sleeve 122 with aerodynamic "flow catcher devices" 226 applied in accordance with an exemplary embodiment. In this exemplary embodiment, the devices 226 are in the form of scoops that are mounted on the surface 223 of the sleeve, along several rows of the impingement sleeve cooling holes 120, extending axially, circumferentially or both, preferably along the side panels that are adjacent similar side panels of the transition duct. As noted above, it is the side panels of the transition piece 10 that are most difficult to cool, given the compact, annular array of combustors and transition pieces in certain gas turbine designs. A typical scoop can either fully or partially surround the cooling hole 120, (for example, the scoop could be in the shape of a half cylinder with or without a top) or partially or fully cover the hole and be generally part-spherical in shape. Other shapes that provide a similar flow catching functionality may also be used. As best seen in FIGS. 8 and 9, each scoop has an edge 227 that defines an open side 229, the edge lying in a plane substantially normal to the surface 223 of the impingement sleeve 122.

Scoops 226 are preferably welded individually to the sleeve, so as to direct the compressor discharge air radially inboard, through the open sides 229, holes 120 and onto the side panels of the transition duct. Within the framework of the invention, the open sides 229 of the scoops 226 can be angled toward the direction of flow. The scoops can be manufactured either singly, in a strip, or as a sheet with all scoops being fixed in a single operation. The number and location of the scoops 226 are defined by the shape of the impingement sleeve, flow within the compressor discharge casing, and thermal loading on the transition piece by the combustor.

In use, air is channeled toward the transition piece surface by the aerodynamic scoops 226 that project out into the high speed air flow passing the impingement sleeve. The scoops 226, by a combination of stagnation and redirection, catch air that would previously have passed the impingement cooling holes 120 due to the lack of static pressure differential to drive the flow through them, and directs the flow inward onto the hot surfaces (i.e., the side panels) of the transition duct, thus reducing the metal temperature to acceptable levels and enhancing the cooling capability of the impingement sleeve.

One advantages of this invention is that it can be applied to existing designs, is relatively inexpensive and easy to fit, and provides a local solution that can be applied to any area on the side panel needing additional cooling.

A series of CFD studies were performed using a design model of a fully turbulated liner 112 and flow sleeve 128 having optimized flow sleeve holes with boundary conditions assumed to be those of a 9FB 12kCI combustion system under base load conditions. Results of the studies indicate that, under normal operating conditions, the design of liner 112 and flow sleeve 128 provide sufficient cooling to the backside of the combustion liner. Predicted metal temperatures along a length of flow sleeve 128 indicate significant reduction in metal temperature variations with reference to FIG. 11.

Figure 10:
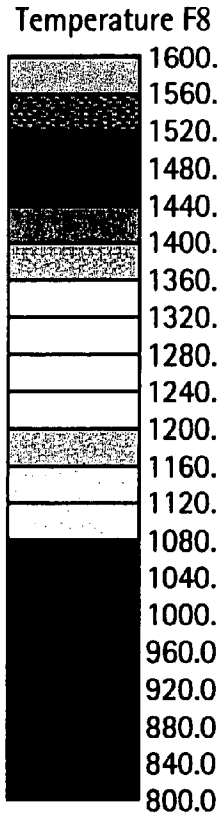
FIG. 10 PRIOR ART
FIG. 10 is a perspective view of a conventional flow sleeve illustrating relative differences in predicted metal temperatures during backside cooling and along a length thereof.
Figure 10:
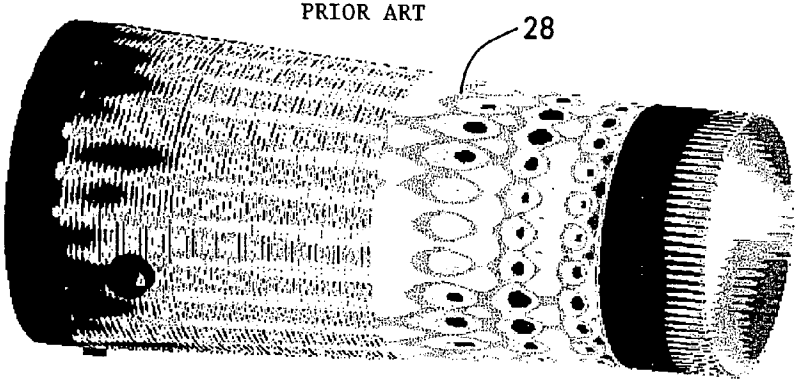
FIG. 10 PRIOR ART
Figure 11:
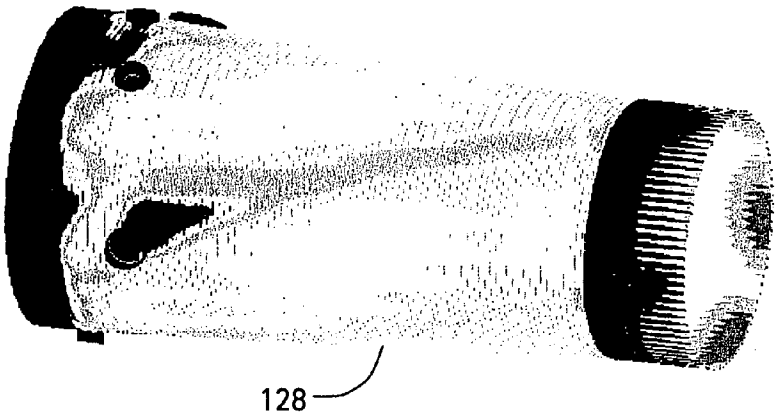
FIG. 11 is a perspective view of a flow sleeve illustrating relative differences in predicted metal temperatures during backside cooling and along a length thereof in accordance with an exemplary embodiment.

FIGS. 10 and 11 represent the metal temperatures within prior art liner 100 and flow sleeve 28 and liner 112 and flow sleeve 128 of the present invention. As shown in FIG. 11, liner flow sleeve 128 exhibits more uniform metal temperatures than the streaking exhibited with flow sleeve 28 in FIG. 10. As noted above, it has been found that by merely altering or balancing the circumferential effective area and its pattern of distribution with respect to the flow and impingement sleeves to optimize uniform air flow to eliminate unwanted streaking in previous designs, thus producing acceptable thermal strains at these increased metal temperatures. Again, this not only helps promote the service life of the liner but also allows a portion of the airflow that previously had to be directed through the liner to now be routed to combustion section 12 of the turbine to improve combustion and reduce emissions.

Optimizing the cooling along a length of the liner has significant advantages over current liner constructions. A particular advantage is that because of the improvement in cooling with the new liner, less air is required to flow through the liner to achieve desired liner metal temperatures; and, there is a balancing of the local velocity of air in the liner passage with the local temperature of the air. This provides a constant cooling heat flux along the length of the liner. As a result of this, there are reduced thermal gradients and thermal stresses within the liner. The reduced cooling air requirements also help prolong the service life of the liner due to reduced combustion reaction temperatures. Finally, the reduced airflow requirements allow more air to be directed to the combustion section of the turbine to improve combustion and reduce turbine emissions.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A combustor for a turbine comprising:

a combustor liner including a plurality of circular ring turbulators arranged in an array axially along a length defining a length of said combustor liner and located on an outer surface thereof;

a first flow sleeve surrounding said combustor liner with a first flow annulus therebetween, said first flow annulus including a plurality of axial channels extending over a portion of an aft end portion of the liner parallel to each other, the cross-sectional area of each channel is one of substantially constant and varying along the length of the channel, said first flow sleeve having a plurality of rows of cooling holes formed about a circumference of said first flow sleeve for directing cooling air from compressor discharge air into said first flow annulus;

a transition piece connected to said combustor liner, said transition piece adapted to carry hot combustion gases to a stage of the turbine;

a second flow sleeve surrounding said transition piece, said second flow sleeve having a second plurality of rows of cooling apertures for directing cooling air from compressor discharge air into a second flow annulus between the second flow sleeve and the transition piece, said first flow annulus connecting to said second flow annulus;

wherein said first plurality of cooling holes and second plurality of cooling apertures are each configured with an effective area to distribute less than 50% of compressor discharge air to said first flow sleeve and mix with cooling air from said second flow annulus.

2. The combustor of claim 1, wherein a first row of said plurality of rows of cooling apertures in said second flow sleeve is located proximate an end interfacing said first flow sleeve.

3. The combustor of claim 2, wherein said first row of cooling apertures allow said compressor discharge air to enter said first flow annulus prior to entering said second flow annulus.

4. The combustor of claim 3, wherein said first row of cooling apertures are located on an angular portion of said second flow sleeve directing air flow therethrough at an acute angle relative to a cross airflow path through said first and second flow annuli.

5. The combustor of claim 4, wherein each cooling aperture includes a diameter of about 0.5 inches.

6. The combustor of claim 1, wherein said first plurality of cooling holes and second plurality of cooling apertures are each configured with an effective area to distribute less than a third of compressor discharge air to said first flow sleeve and mix with a remaining compressor discharge air flowing from said second flow annulus.

7. The combustor of claim 1, wherein said liner is a wrought alloy liner.

8. The combustor of claim 1, wherein the cross-sectional area of each channel uniformly decreases along the length of the channel from an air inlet for admitting air into each channel to an air outlet by which air is discharged from the liner end of the liner.

9. The combustor of claim 8, wherein a height of each channel uniformly decrease along the length of the channel from the air inlet end to the air outlet end of the liner, thereby to reduce thermal strain occurring at the aft end of the liner so to prolong the useful life of the liner and reduce the amount of air needed to flow through the liner to affect a desired level of cooling in the transition region.

10. The combustor of claim 9, wherein height of the channels substantially decreases from the air inlet end to the air outlet end of the liner.

11. The combustor of claim 10, wherein the height of the channels decreases by at least 40% from the air inlet end to the air outlet end of the liner.

12. The combustor of claim 1 further comprising a plurality of flow catcher devices, each flow catcher device comprising a scoop fixed to an outside surface of said second flow sleeve about a portion of a respective one of said cooling apertures and having an open side defined by an edge of the scoop lying in a plane substantially normal to said outside surface and arranged to face a direction of compressor discharge air flow, such that said flow catcher devices redirect compressor discharge air flow through said second flow sleeve and onto said transition piece.

13. The combustor of claim 12, wherein said plurality of flow catcher devices are welded to said second flow sleeve.

14. The combustor of claim 12, wherein each flow catcher device has an open side facing a direction of compressor discharge air flow, such that said flow catcher devices redirect compressor discharge air flow through said second flow sleeve and onto said transition piece, said plurality of flow catcher devices disposed with at least one row of some of said cooling apertures.

15. The combustor of claim 14, wherein each flow catcher device is arranged along opposite side panels defining said second flow sleeve, substantially adjacent corresponding side panels defining said transition piece.

16. A turbine engine comprising:

a combustion section;

an air discharge section downstream of the combustion section;

a transition region between the combustion and air discharge section;

a turbulated combustor liner defining a portion of the combustion section and transition region, said turbulated combustor liner including a plurality of circular ring turbulators arranged in an array axially along a length defining a length of said combustor liner and located on an outer surface thereof;

a first flow sleeve surrounding said combustor liner with a first flow annulus therebetween, said first flow annulus including a plurality of axial channels extending over a portion of an aft end portion of the liner parallel to each other, the cross-sectional area of each channel is one of substantially constant and varying along the length of the channel, said first flow sleeve having a plurality of rows of cooling holes formed about a circumference of said first flow sleeve for directing cooling air from compressor discharge air into said first flow annulus;

a transition piece connected to at least one of said combustor liner and said first flow sleeve, said transition piece adapted to carry hot combustion gases to a stage of the turbine corresponding to the air discharge section;

a second flow sleeve surrounding said transition piece, said second flow sleeve having a second plurality of rows of cooling apertures for directing cooling air from compressor discharge air into a second flow annulus between the second flow sleeve and the transition piece, said first flow annulus connecting to said second flow annulus;

wherein said first plurality of cooling holes and second plurality of cooling apertures are each configured with an effective area to distribute less than 50% of compressor discharge air to said first flow sleeve and mix with cooling air from said second flow annulus serving to cool air flowing through the transition region of the engine between the combustion and air discharge sections thereof.

17. The engine of claim 16, wherein said first plurality of cooling holes and second plurality of cooling apertures are each configured with an effective area to distribute less than a third of compressor discharge air to said first flow sleeve and mix with a remaining compressor discharge air flowing from said second flow annulus.

18. The engine of claim 16, further comprising a plurality of flow catcher devices, each flow catcher device comprising a scoop fixed to an outside surface of said second flow sleeve about a portion of a respective one of said cooling apertures and having an open side defined by an edge of the scoop lying in a plane substantially normal to said outside surface and arranged to face a direction of compressor discharge air flow, such that said flow catcher devices redirect compressor discharge air flow through said impingement sleeve and onto said transition piece.

19. The engine of claim 16, wherein a first row of said plurality of rows of cooling apertures in said second flow sleeve is located proximate an end interfacing said first flow sleeve.

20. A method of cooling a combustor liner of a gas turbine combustor, said combustor liner having a substantially circular cross-section, and a first flow sleeve surrounding said liner in substantially concentric relationship therewith creating a first flow annulus therebetween for feeding air to the gas turbine combustor, and wherein a transition piece is connected to said combustor liner, with the transition piece surrounded by a second flow sleeve, thereby creating a second flow annulus in communication with said first flow annulus; the method comprising:

providing a plurality of axially spaced rows of cooling holes in said flow sleeves, each row extending circumferentially around said flow sleeves, a first of said rows in said second sleeve is located proximate an end where said first flow sleeve and said second flow sleeve interface;

supplying cooling air from compressor discharge to said cooling holes;

configuring said cooling holes with an effective area to distribute less than a third of compressor discharge air to said first flow sleeve and mix with a remaining compressor discharge air flowing from said second flow annulus, and configuring said first flow annulus with a plurality of axial channels extending over a portion of an aft end portion of the liner parallel to each other, the cross-sectional area of each channel is one of substantially constant and varying along a length of the channel.

21. The method of claim 20, further comprising:

forming a plurality of discrete ring turbulators arranged in spaced relationship on said outer surface of said combustor liner to enhance heat transfer, each ring turbulator comprising a raised rib in planform view of substantially round or oval shape extending radially from said outer surface, defining a hollow region within said rib that is closed at one end by said outside surface of said combustor liner, said hollow regions adapted to create vortices in cooling air flowing across said outside surface of said combustor liner.

22. The method of claim 20, wherein the cross-sectional area of each channel uniformly decreases along the length of the channel from an air inlet for admitting air into each channel to an air outlet by which air is discharged from the liner end of the liner.

23. The method of claim 22, wherein a height of each channel uniformly decrease along the length of the channel from the air inlet end to the air outlet end of the liner, thereby to reduce thermal strain occurring at the aft end of the liner so to prolong the useful life of the liner and reduce the amount of air needed to flow through the liner to affect a desired level of cooling in the transition region.

24. The method of claim 20, further comprising:

configuring a plurality of flow catcher devices, each flow catcher device comprising a scoop fixed to an outside surface of said second flow sleeve about a portion of a respective one of said cooling apertures and having an open side defined by an edge of the scoop lying in a plane substantially normal to said outside surface and arranged to face a direction of compressor discharge air flow, such that said flow catcher devices redirect compressor discharge air flow through said second flow sleeve and onto said transition piece.

* * * * *

UNITED STATES PATENT AND TRADEMARK OFFICE

CERTIFICATE OF CORRECTION

PATENT NO. : 7,010,921 B2
APPLICATION NO. : 10/709886
DATED : March 14, 2006
INVENTOR(S) : Intile et al.

It is certified that error appears in the above-identified patent and that said Letters Patent is hereby corrected as shown below:

Column 3:
Line 29, before "annulus" insert -- first --

Column 5:
Line 27, after "so" insert -- as --
Line 43, after "so" insert -- as --

Column 7:
Line 6, after "end delete "128" and insert therefor -- 130 --

Column 8:
Line 19, after "one" delete "advantages" and insert therefor -- advantage --

Column 10:
Line 8, after "so" insert -- as --

Column 12:
Line 30, before "end" delete "liner" and insert therefor -- outlet --
Line 35, after "so" insert -- as --

Signed and Sealed this

Fifth Day of September, 2006

JON W. DUDAS
*Director of the United States Patent and Trademark Office*